US005529804A

United States Patent [19]

Bonneau et al.

[11] Patent Number: 5,529,804

[45] Date of Patent: Jun. 25, 1996

[54] METHOD OF MAKING METAL COMPOSITE POWDERS

[75] Inventors: Maxime Bonneau, Le Fontanil; Nicolas Chardon, Echirolles, both of France; Sara Andersson, Solna; Mamoun Muhammed, Djursholm, both of Sweden

[73] Assignees: Sandvik AB, Sandviken, Sweden; Eurotungstene Poudres S.A., Grenoble, France

[21] Appl. No.: 412,930

[22] Filed: Mar. 29, 1995

[30] Foreign Application Priority Data

Mar. 31, 1994 [SE] Sweden ..... 9401150

[51] Int. Cl.$^6$ ..... B05D 7/00

[52] U.S. Cl. ..... 427/217; 427/226; 427/383.3; 427/443.1; 419/10; 419/13; 419/14; 419/18; 419/35

[58] Field of Search ..... 427/217, 226, 427/443.1, 383.3; 419/10, 13, 14, 18, 35

[56] References Cited

U.S. PATENT DOCUMENTS 4,268,536 5/1981 Beckenbaugh et al. ..... 427/443.1

4,539,041 9/1985 Figlarz et al. ..... 75/0.5 A 4,770,907 9/1988 Kimura ..... 427/217

FOREIGN PATENT DOCUMENTS 346473 4/1931 United Kingdom .

*Primary Examiner*—Shrive Beck

*Assistant Examiner*—David M. Maiorana

*Attorney, Agent, or Firm*—Burns, Doane, Swecker & Mathis

[57] ABSTRACT

A process for the production of hard materials wherein hard constituent powders are coated with cobalt and/or nickel metal in solution by reducing the metals from a suitable compound such as an oxide, hydroxide or salt with a polyol while keeping the powder in suspension. The polyol functions both as a solvent and a reducing agent at the same time and is present in an amount of at least 5 times more moles polyol than moles metal. There is obtained an even distribution of the cobalt and/or nickel over the surface of the hard constituent powder without the formation of islands of pure metal.

18 Claims, 2 Drawing Sheets

METHOD OF MAKING METAL COMPOSITE POWDERS

BACKGROUND OF THE INVENTION

The present invention relates to a method of producing metal composite materials such as cemented carbide.

Cemented carbide and titanium-based, carbonitride alloys often referred to as cermets consist of hard constituents based on carbides, nitrides and/or carbonitrides of Ti, Zr, Hf, V, Nb, Ta, Cr, Mo and/or W in a binder phase essentially based on Co and/or Ni. They are made by powder metallurgical methods of milling a powder mixture containing powders forming the hard constituents and binder phase, pressing and sintering.

The milling operation is an intensive milling in mills of different sizes and with the aid of milling bodies. The milling time is on the order of several hours to several days. Such procedures are believed to be necessary in order to obtain a uniform distribution of the binder phase in the milled mixture. It is further believed that the intensive milling creates a reactivity of the mixture which further promotes the formation of a dense structure.

British Patent No. 346,473 discloses a method of making cemented carbide bodies. Instead of milling, the hard constituent grains are coated with binder phase via an electrolytic method, pressed and sintered to a dense structure. This and other similar methods are, however, not suited for cemented carbide production on a large industrial scale, and milling is almost exclusively used within the cemented carbide industry today. However, milling has its disadvantages. For instance, during the long milling time wear of the milling bodies contaminates the milled mixture and it is necessary to compensate for such contamination. The milling bodies can also break during milling and remain in the structure of the sintered bodies. Furthermore, even after an extended milling a random rather than an ideal homogeneous mixture may be obtained. Moreover, in order to ensure an even distribution of the binder phase in the sintered structure sintering has to be performed at a higher temperature than would otherwise be necessary.

The properties of the sintered metal composite materials containing two or more components depend to a great extent on how well the starting materials are mixed. An ideal mixture of particles of two or more kinds especially if one of the components occurs as a minor constituent (which is the case for the binder phase in ordinary metal composite materials) is difficult to obtain. In practice, after extended mixing a random rather than an ideal homogeneous mixture is obtained. In order to obtain an ordered mixing of the components in the latter case, the minor component can be introduced as a coating. The coating can be achieved by the use of various chemical techniques. In general, it is required that some type of interaction between the coated component and the coating be present, i.e., adsorption, chemisorption, surface tension or any type of adhesion.

U.S. Pat. No. 4,539,041 discloses the well known polyol process. This process is being used today for the manufacture of cobalt and nickel metal powders with a small particle size. These metal powders can, for example, be used for the production of hard materials as disclosed in WO SE92/00234. In this process a number of transition metals such as Co, Ni, Cd, Pb as well as more easily reducible metals such as Cu and precious metals can be reduced to the metallic state by a polyol such as: ethylene glycol, diethylene glycol or propylene glycol. A complete reduction is obtained after about 24 hours and the metal is precipitated as a fine powder. The reaction proceeds via dissolution with the polyol functioning both as a solvent and as a reducing agent at the same time.

SUMMARY OF THE INVENTION

It is an object of this invention to avoid or alleviate the problems of the prior art.

The invention provides a method of making a metal coated hard constituent powder. The method includes forming a suspension of hard constituent powder and a metal compound and forming a metal coating on the hard constituent powder by reducing the metal compound with a polyol while keeping the hard constituent powder in suspension. The polyol functions both as a solvent and as a reducing agent at the same time and is present in an amount of at least five times more moles polyol than moles metal.

According to various features of the invention, the metal can be selected from the group consisting of cobalt, nickel and mixtures thereof and the hard constituent can be selected from the group consisting of carbides, nitrides and/or carbonitrides of Ti, Zr, Hf, V, Nb, Ta, Cr, Mo and/or W. The metal coating preferably completely covers the hard constituent powder. The metal compound can comprise a metal salt, an oxide, a metal hydroxide or mixture thereof. The polyol can comprise ethylene glycol, diethylene glycol or propylene glycol. The yield of metal reduction in the process is at least 80%, preferably at least 90%.

During the process, the suspension can be heated. For instance, the suspension can be boiled and/or stirred. After the metal coating is formed, the metal coated powder can be separated from the suspension, washed and dried. The metal coated powder can be formed into a sintered body by compacting the powder into a shaped body and sintering the shaped body.

DETAILED DESCRIPTION OF THE PREFERRED EMBODIMENTS

Figure 1:
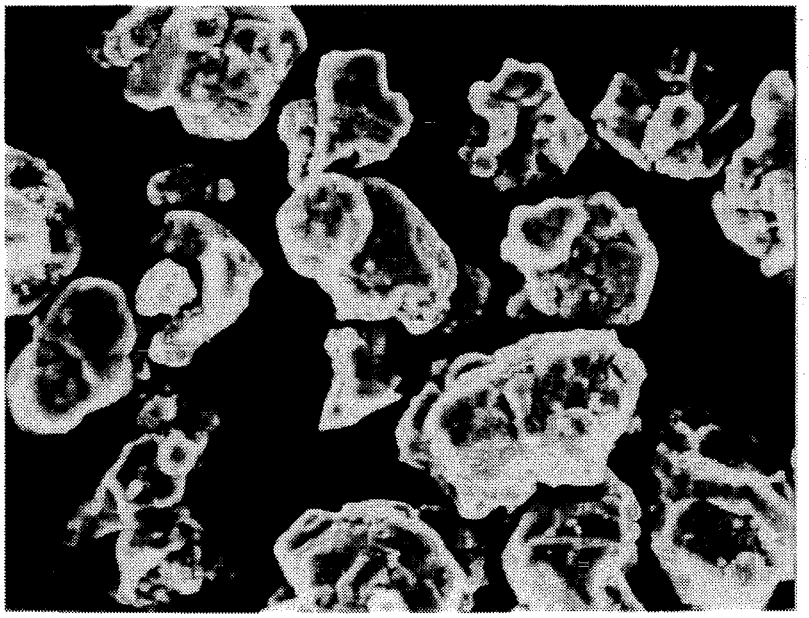
FIGS. 1, 3 and 4 show 5000X enlargements of WC- or (Ti,W)C-powder coated with Co or Ni according to the method of the invention.

According to the present invention it has now surprisingly been found that it is possible to coat hard constituent powders with Co and/or Ni by using the polyol process. In this process, the hard constituent powders are in suspension in a polyol solution containing a suitable compound of Co and/or Ni. During reduction of cobalt and nickel by the polyol, cobalt and/or nickel metal precipitation occurs on the surface of the hard constituent powders.

The metals are precipitated with a quite even distribution over the surface of the carbides without forming separate islands of the precipitated metal. Surprisingly, the reaction speed is considerably increased when the hard constituent is kept in suspension as compared to the reaction time needed to carry out the reduction without any hard constituent present. This indicates that the hard constituent has a catalytic effect on the reduction. When nickel is reduced, the reaction is somewhat faster and the yield somewhat higher as compared with cobalt reduction. The precipitated metal particles are in both cases spherical but the particle size for nickel is smaller than for cobalt.

According to the method of the invention, an oxide, a hydroxide or a salt of Co and/or Ni is dissolved in an excess quantity of polyol, preferably ethylene glycol, diethylene glycol or propylene glycol, the excess being more than 5, preferably more than 10 times more moles polyol than moles Co and/or Ni. The polyol functions both as a solvent and as a reducing agent at the same time. The powder of the hard constituent to be coated, such as WC, (Ti,W)C, Ta,Nb)C, (Ti,Ta,Nb)C, (Ti,W) (C,N), TiC, TaC, NbC, VC and $Cr_3C_2$, preferably well-deagglomerated, e.g., by jet milling, is added to the solution. The amount of hard constituent is chosen with regard to the final composition desired and considering that the yield of Co and/or Ni is about 95%. The solution is heated to boiling under stirring and is allowed to boil for about 5 hours while volatile products are removed by distillation. When the reaction is completed the polyol is removed from the reaction mixture and the powder is washed with ethanol, centrifuged and dried at 40° C. for about 24 hours.

The coated powder is mixed with a pressing agent in ethanol to form a slurry either alone or with other coated hard constituent powders and/or uncoated hard constituent powders and/or binder phase metals and/or carbon to obtain the desired composition. The slurry then is dried, compacted and sintered in a conventional manner to obtain a sintered body of hard constituents in a binder phase.

The following examples are given to illustrate various aspects of the invention.

EXAMPLE 1

WC coated with 6% Co was made in the following way: 480 g of WC was suspended in 600 ml ethylene glycol, the amount of dry substance was 44 weight %. To this suspension, 51.34 g of cobalt hydroxide was added while stirring and the suspension was heated until boiling. A surplus of ethylene glycol was used (20 times more moles ethylene glycol than moles cobalt). The reaction mixture was allowed to boil under vigorous stirring for 5 hours while volatile by-products were removed from the reaction mixture by distillation. When the reaction was completed the ethylene glycol was removed from the reaction mixture and the powder was washed with ethanol, centrifuged and dried at 40° C. for about 24 hours.

The X-ray powder diffraction spectrum of the coated powder showed that it only contained pure WC and Co-metal. No other phases could be detected. The yield of cobalt was about 94%.

Figure 2:
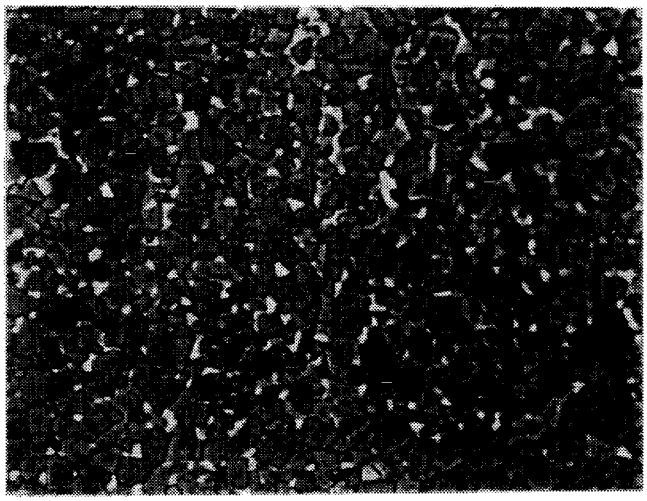
FIGS. 2 and 5 show sintered structures of cemented carbide made from powder according to the invention.

FIG. 1 shows a 5000X enlargement of the WC-powder coated with Co. The particle size of cobalt is 1–2 μm. The cobalt seems to be quite evenly distributed over the carbide without forming any cobalt islands. The mean particle size of WC coated with 6% cobalt metal is about the same as for pure WC which supports the conclusions that no islands of cobalt metal are formed. The powder was mixed with polyethylene glycol, pressed and sintered according to standard practice. A dense structure was obtained as shown in FIG. 2.

EXAMPLE 2

(Ti,W)C coated with 3% cobalt was made in the following way: 310 g of (Ti,W)C was suspended in 400 ml ethylene glycol, the amount of dry substance was 43 weight %. To this suspension, 16.09 g of cobalt hydroxide was added while stirring and the suspension was heated until boiling. A surplus of ethylene glycol was used (40 times more moles ethylene glycol than moles cobalt). The reaction mixture was allowed to boil under vigorous stirring for 5 hours while volatile by-products were removed continuously by distillation. After the reaction was completed the ethylene glycol was removed from the reaction mixture and the powder was washed with ethanol, centrifuged and dried at 40° C. for about 24 hours.

X-ray powder diffraction spectrum of the coated powders showed that they only contained (Ti,W)C and Co-metal. No other phases could be detected.

Figure 3:
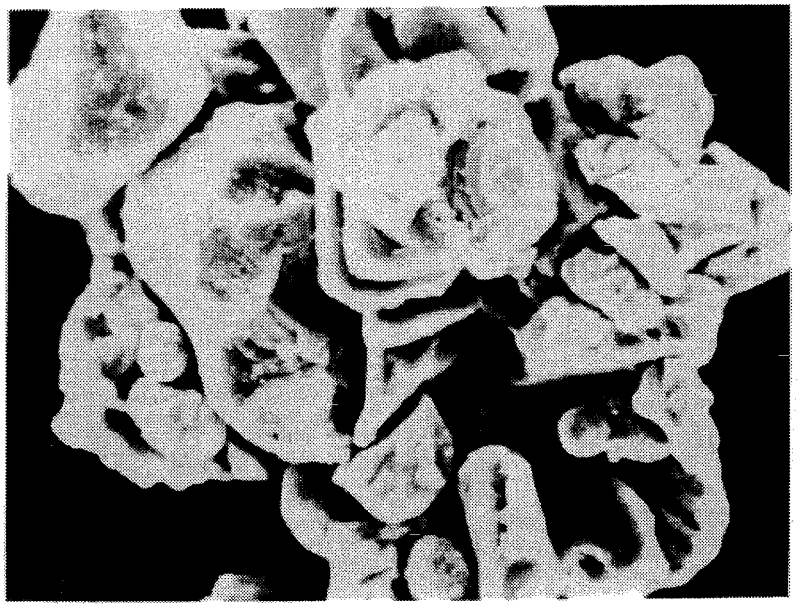

FIG. 3 shows a 5000X enlargement of the (Ti,W)C-powder coated with Co. The mean particle size of (Ti,W)C coated with 3% cobalt metal is the same as for pure (Ti,W)C which supports the conclusions that no islands of cobalt metal are formed. In this case the amount of cobalt was too small to evaluate its distribution.

EXAMPLE 3

WC coated with 6% nickel was made in the following way: 490 g of WC was suspended in 580 ml ethylene glycol, the amount of dry substance was 46 weight %. To this suspension, 52.19 g of nickel hydroxide was added while stirring and the suspension was heated until boiling. To the boiling mixture, 12 ml of 2.5M $H_2SO_4$ (totally 2% of the liquid phase), was added to increase the solubility of nickel hydroxide. A surplus of ethylene glycol was used (20 times more moles ethylene glycol than moles cobalt). The reaction mixture was allowed to boil under vigorous stirring for 4 hours while volatile by-products were removed continuously by distillation. After the reaction was completed the ethylene glycol was removed from the reaction mixture and the powder was washed with ethanol, centrifuged and dried at 40° C. for about 24 hours.

X-ray powder diffraction spectrum of the coated powder showed that it only contained WC and Ni-metal. No other phases could be detected. The yield of Ni was 98%.

Figure 4:
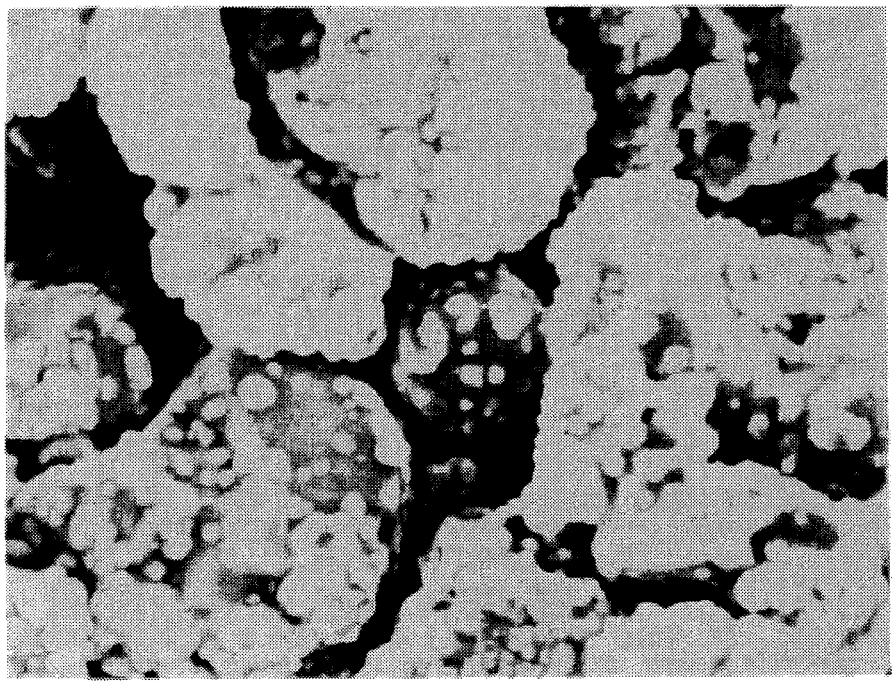
Figure 5:
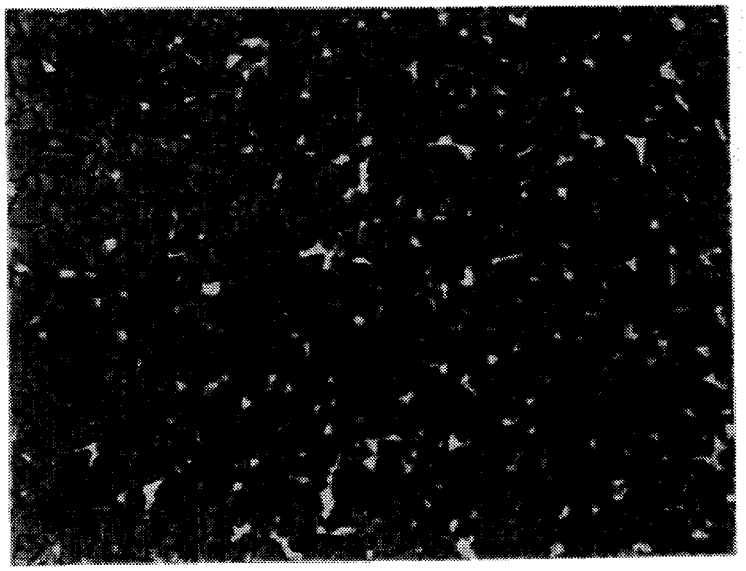

FIG. 4 shows a 5000X enlargement of the WC-powder coated with Ni. The particle size of nickel is around 0.5 μm. The nickel seems to be quite evenly distributed over the carbide without forming any islands of nickel. The mean particle size of WC coated with 6% nickel metal is larger than for pure WC, which could be explained by some degree of agglomeration. The powder was mixed with polyethylene glycol, pressed and sintered according to standard practice. A dense structure was obtained as shown in FIG. 5 .

EXAMPLE 4

(Ti,W)C coated with 11% Co was made in the following way: 462.8 g of (Ti,W)C was suspended in 700 ml ethylene glycol. To this suspension, 95.97 g of cobalt hydroxide was added while stirring and the suspension was heated until boiling. The excess of ethylene glycol was 12 times (12 times more moles ethylene glycol than moles cobalt). The reaction mixture was allowed to boil under vigorous stirring for 5 hours while volatile by-products were removed from the reaction mixture by distillation. When the reaction was completed, the ethylene glycol was removed from the reaction mixture and the powder was washed with ethanol, centrifuged and dried at 40° C. for about 24 hours.

The X-ray powder diffraction spectrum of the coated powder showed that it only contained (Ti,W)C and Co-metal. No other phases could be detected. The cobalt was quite evenly distributed over the carbide without forming any islands. The yield was about 94%.

EXAMPLE 5

Example 1 was repeated using 489 g WC and 57.9 g cobalt hydroxide but only half the amount of ethylene glycol, i.e., the excess of ethylene glycol was only 10 times (10 times more moles ethylene glycol than moles cobalt). The same result as in Example 1 was obtained but the yield of cobalt decreased to about 85%.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method of making a metal coated hard constituent powder comprising:

forming a suspension of hard constituent powder and a metal compound;

forming a metal coating on the hard constituent powder by reducing the metal compound with a polyol while keeping the hard constituent powder in suspension, the polyol functioning both as a solvent and as a reducing agent at the same time and being present in an amount of at least 5 times more moles polyol than moles metal.

2. The method of claim 1, wherein the metal is selected from the group consisting of Co, Ni and mixtures thereof.

3. The method of claim 1, wherein the hard constituent is selected from the group consisting of carbides, nitrides and/or carbonitrides of Ti, Zr, Hf, V, Nb, Ta, Cr, Mo and/or W.

4. The method of claim 1, wherein the metal coating completely covers the hard constituent powder.

5. The method of claim 1, wherein the metal compound comprises a metal salt.

6. The method of claim 1, wherein the metal compound comprises a metal oxide.

7. The method of claim 1, wherein the metal compound comprises a metal hydroxide.

8. The method of claim 1, wherein the polyol comprises ethylene glycol, diethyleneglycol or propylene glycol.

9. The method of claim 1, wherein the yield of metal reduction is at least 80%.

10. The method of claim 1, wherein the yield of metal reduction is at least 90%.

11. The method of claim 1, wherein the suspension is heated.

12. The method of claim 1, wherein the suspension is boiled and/or stirred.

13. The method of claim 1, wherein the metal coated powder is separated from the suspension, washed and dried.

14. The method of claim 1, wherein the metal coated powder is compacted into a shaped body and the shaped body is sintered.

15. The method of claim 1, wherein the metal coating is a pure metal.

16. The method of claim 1, wherein the polyol is present in an amount of at least 10 times more moles polyol than moles metal.

17. The method of claim 1, wherein the polyol is present in an amount of at least 20 times more moles polyol than moles metal.

18. The method of claim 1, wherein the polyol is present in an amount of at least 40 times more moles polyol than moles metal.

* * * * *